US006999711B2

(12) United States Patent
Suzuki et al.

(10) Patent No.: US 6,999,711 B2
(45) Date of Patent: Feb. 14, 2006

(54) IMAGE FORMING APPARATUS HAVING FLASH LAMP AND IMAGE FORMING METHOD USING THE SAME

(75) Inventors: Eiji Suzuki, Kanagawa (JP); Masatoshi Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 151 days.

(21) Appl. No.: 10/732,314

(22) Filed: Dec. 11, 2003

(65) Prior Publication Data

US 2004/0126159 A1 Jul. 1, 2004

(30) Foreign Application Priority Data

Dec. 25, 2002 (JP) ..... 2002-375078

(51) Int. Cl.
*G03G 15/20* (2006.01)

(52) U.S. Cl. ..... 399/336; 219/216

(58) Field of Classification Search ..... 399/336, 399/335; 347/156

See application file for complete search history.

(56) References Cited

U.S. PATENT DOCUMENTS 4,723,147 A * 2/1988 Dyer ..... 399/355 X
6,567,621 B1 * 5/2003 Miyoshi et al. ..... 399/19

FOREIGN PATENT DOCUMENTS

JP A 62-254163 11/1987
JP 01-188884 A * 7/1989
JP A 6-194969 7/1994

* cited by examiner

*Primary Examiner*—Sophia S. Chen
(74) *Attorney, Agent, or Firm*—Oliff & Berridge, PLC

(57) ABSTRACT

An image forming apparatus includes a plurality of image forming units for forming an image on a printing medium such as a sheet of paper. A plurality of color types of toner are arranged on a transport path of the printing medium. Toner images corresponding to the color types of toner are color-by-color transferred onto the printing medium. Light emitted from a flash lamp melts and fixes the toner images. The fixing order of the toner images corresponding to the color types of toner is decided so that the toner images are fixed in ascending order of toner's absorptivity of the light emitted from the flash lamp or in descending order of toner's reflectivity of the light.

12 Claims, 16 Drawing Sheets

MEASURED VALUE OF ACTUAL FIXING RATE (%)

| SAMPLE \ NUMBER OF TIMES | 1 | 2 | 3 |
|---|---|---|---|
| BLACK TONER | 88.19144 | 99.18851 | 99.80512 |
| COLOR TONER | 72.88938 | 88.07288 | 97.29415 |

TONER #3 INCLUDES 0.25% OF INFRARED-ABSORBING AGENT WHEREAS TONER #4 INCLUDES 1.05% OF INFRARED-ABSORBING AGENT

IMAGE FORMING APPARATUS HAVING FLASH LAMP AND IMAGE FORMING METHOD USING THE SAME

The present disclosure relates to the subject matter contained in Japanese Patent Application No. 2002-375078 filed on Dec. 25, 2003, which is incorporated herein by reference in its entirety.

BACKGROUND OF THE INVENTION

1. Field of the Invention

The present invention relates to an image forming apparatus and an image forming method using an electrophotographic process as used in a color laser printer or the like for forming an image on a printing medium such as a sheet of paper by transferring toner images corresponding to different color types of toner onto the printing medium and melting and fixing the toner images by light emitted from a flash lamp.

2. Description of the Related Art

Generally, an electrophotographic image forming apparatus for forming an image on a printing medium such as a sheet of paper by using an electrophotographic process is configured so that the image is formed by the following steps (1) and (2).

(1) After a photoconductor drum is evenly charged, the photoconductor drum is exposed to light in accordance with target image data to thereby form an electrostatic latent image. Then, developing agents are supplied to the photoconductor drum and the electrostatic latent image is developed by different color types of toner to thereby form a toner image on the photoconductor drum. Examples of toner generally used include: color toner such as yellow toner, red toner (magenta toner) and blue toner (cyan toner) used for a color image; and black toner (or monochrome toner) mainly used for a monochrome image.

(2) The toner image formed on the photoconductor drum is transferred onto a printing medium. The toner image on the printing medium is melted and fixed by a fixing portion.

A recent image forming apparatus has a tendency to need high-speed color printing and a high-quality image on the printing medium. Particularly the fixing portion in the image forming apparatus has large influence on improvement in high-speed color printing and a high-quality image on the printing medium.

As to the fixing portion, there is generally used a flash type fixing unit for melting and fixing the toner image on the printing medium by light emitted from a flash lamp or a heat roller type fixing unit for pressurizing and heating the toner image on the printing medium by a heat roller to thereby fix the toner image.

In the heat roller type fixing unit, because the toner image with colors superposed on one another on the printing medium such as a sheet of paper is melted while pressurized by the heat roller so as to be fixed on a surface of the printing medium, the sheet of paper after fixing has relatively few wrinkles. For high-speed color printing, however, the printing medium such as a sheet of paper carries heat generated in the heat roller when the toner image is fixed. As a result, the temperature of the heat roller surface varies, so that temperature control can hardly be performed at the time of fixing.

Furthermore, when the printing medium is a continuous sheet of paper, a heat roller disconnection mechanism is required at the time of interruption of printing so that the printing medium in the fixing unit is not affected by the heat of the heat roller when printing is interrupted. Accordingly, the fixing unit is complicated in structure.

On the contrary, in the flash type fixing unit, the toner image with colors superposed on one another on the printing medium such as a sheet of paper is melted by heat of light emitted from the flash lamp so as to be fixed on a surface of the printing medium. Accordingly, while the flash type fixing unit can be prevented from coming into contact with the toner image on the printing medium when the toner image is fixed, printing can be performed at a high speed compared with the heat roller type fixing unit. Accordingly, even in the case where toner images corresponding to different color types of toner are color-by-color fixed, fixing can be completed in a short time compared with the heat roller type fixing unit.

Furthermore, even in the case where the printing medium is a continuous sheet of paper, there is no influence of heat of light emitted from the flash lamp at the time of interruption of printing because the flash lamp is switched off when printing is interrupted. Accordingly, the fixing unit can be simplified in structure.

For this reason, the flash type fixing unit adapted for relatively high-speed printing and simple in structure is used popularly in the related-art image forming apparatus.

The configuration of an image forming apparatus having such a flash type fixing unit has been described in JP-A-6-194969 (lines 2 to 20 of page 1, lines 4 to 20 of page 2, lines 30 to 35 of page 6, and FIG. 1) and JP-A-62-254163 (lines 4 to 11 in lower left column of page 1, line 6 in upper left column of page 3 to line 14 in upper right column of page 3, line 18 in upper left column of page 4 to line 8 in upper right column of page 4, and FIG. 1).

More specifically, JP-A-6-194969 has disclosed the configuration of an image forming apparatus having a temporary fixing unit for temporarily fixing images, which are transferred onto a recording medium by a plurality of image forming stations respectively, by flash light exposure in each of the image forming stations. The temporary fixing operation by the temporary fixing unit increases the adsorbability of developing agents transferred onto the recording medium by the image forming stations.

On the other hand, JP-A-62-254163 has disclosed the configuration of a color image forming apparatus in which a heating unit not contacting a transfer medium transport unit is provided at a previous stage of a transfer unit so that a transfer medium is heated by the heating unit before each transfer step to thereby vaporize and scatter water from a sheet of paper to prevent the sheet of paper from being deformed even in the case where the fixing operation of the flash type fixing unit is performed after the heating step.

In the related-art image forming apparatus (particularly, color image forming apparatus) having a flash type fixing unit, when a toner image on a printing medium is melted and fixed by heat of light emitted from a flash lamp in accordance with each of colors in different color types of toner, toner's absorptivity (or reflectivity) of light emitted from the flash lamp varies according to the color of color toner for forming the toner image. Accordingly, if a color image is fixed while all the conditions for fixing different color types of toner are set to be equal to the condition for fixing black color for forming a monochrome image, there is a problem that lowering of fixing characteristic (i.e., fixing rate) is caused by poor fixing of color toner because color toner cannot efficiently absorb the energy of the light emitted from the flash lamp.

On the other hand, in the related-art image forming apparatus, the toner image portion on the printing medium heats because the toner image is fixed by heat of light emitted from the flash lamp. For this reason, when toner images corresponding to different color types of toner are color-by-color fixed, undulations or wrinkles are apt to be generated in the printing medium because of partial shrinkage of the printing medium or shrinkage of molten toner. As a result, there is a problem that transfer missing or transfer failure is caused by the undulations or wrinkles of the printing medium when a toner image corresponding to one color is fixed and then a toner image corresponding to another color is transferred onto the printing medium.

SUMMARY OF THE INVENTION

The invention is developed to solve the problems and an object of the invention is to provide an image forming apparatus and an image forming method in which: fixing characteristic of toner is prevented from being lowered when toner images corresponding to color types of toner are color-by-color fixed on a printing medium by a flash type fixing unit; and undulations or wrinkles are prevented from being caused in the printing medium because of partial shrinkage of the printing medium or shrinkage of molten toner.

To solve the problems, an image forming apparatus for forming an image on a printing medium according to the embodiment of the invention includes a plurality of printing units and flash lamps. The printing units are disposed in tandem on a transport path of the printing medium, generate images of color toners in accordance with image data to be printed on the printing medium, and transfer the images of the color toners color-by-color onto the printing medium. The flash lamps emit light to melt and fix the toner images. The printing units are disposed so that the toner images corresponding to the color types of toner are color-by-color fixed in ascending order of toner's absorptivity of the light emitted from the flash lamp (or in descending order of toner's reflectivity of the light).

Preferably, the order of the printing units is determined as follows. The printing unit having the color toner of yellow, red or blue is selected as a first printing unit. The printing unit having black toner is selected as the last printing unit.

Preferably, an infrared absorbing agent for absorbing energy of light in the infrared region is added to the toner of the at least one color of yellow, red and blue.

An image forming method includes developing an electrostatic latent image formed on a photoconductor drum in accordance with image data to be printed on a printing medium; color-by-color transferring toner images, which is formed on the photoconductor drum in accordance with the electrostatic latent image, onto the printing medium in accordance with a plurality of color types of toner disposed along a transport path of the printing medium; and melting and fixing the toner images by light emitted from a flash lamp to form the image on the printing medium. The toner images corresponding to the color types of toner are color-by-color fixed in ascending order of toner's absorptivity of the light emitted from the flash lamp.

In short, in the image forming apparatus and the image forming method according to the embodiment of the invention, toner images corresponding to color types of toner are color-by-color fixed on a printing medium by a flash type fixing unit so that a toner image corresponding to toner having the lowest absorptivity of light emitted from a flash lamp (or the highest reflectivity of the light) is fixed first and that a toner image corresponding to toner having the highest absorptivity of the light emitted from the flash lamp (or the lowest reflectivity of the light) is fixed finally.

Consequently, in the embodiment of the invention, because the order of fixing the toner images on the printing medium is decided in advance, the number of repetitions for fixing toner having low absorptivity of the light emitted from the flash lamp can be increased. Accordingly, toner having low absorptivity can sufficiently absorb the energy of the light emitted from the flash lamp, so that lowering of fixing characteristic can be prevented from being caused by poor fixing of toner.

Furthermore, in the embodiment of the invention, because toner images are color-by-color fixed in ascending order of toner's absorptivity of the light emitted from the flash lamp, heat generated in the toner image portion on the printing medium is reduced compared with the related-art case. Accordingly, partial shrinkage of the printing medium or shrinkage of molten toner can be suppressed, so that transfer failure can be prevented from being caused by undulations or wrinkles of the printing medium.

DETAILED DESCRIPTION OF THE PREFERRED EMBODIMENTS

Configurations, operations, etc. of preferred embodiments of the invention will be described below with reference to the accompanying drawings (FIGS. 1 to 16).

Figure 1:
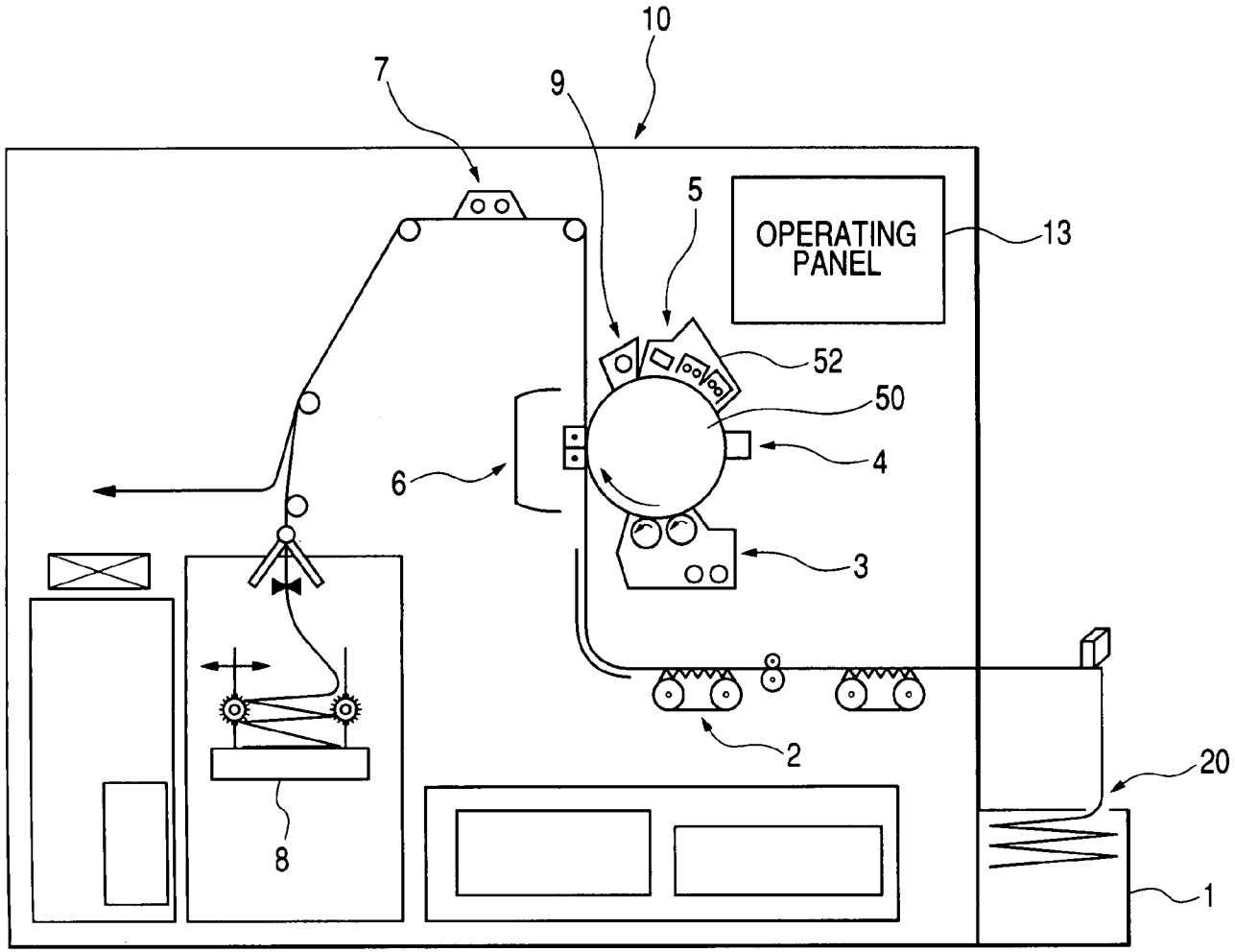
FIG. 1 is a front view showing the overall configuration of an electrophotographic image forming apparatus according to the invention.

FIG. 1 is a front view showing the overall configuration of an electrophotographic image forming apparatus according to an embodiment of the invention. The configuration of an electrophotographic image forming apparatus 10 such as a printer is shown here in brief in the condition that a sheet of paper 20 is used as a printing medium.

The image forming apparatus shown in FIG. 1 includes, as main parts, a development portion 3 for developing an electrostatic latent image formed on a photoconductor drum 50 of a recording portion 5, a transfer portion 6 for transferring toner images formed on the photoconductor drum 50 in accordance with the electrostatic latent image developed by the development portion 3 onto the sheet of paper 20, and a flash type fixing portion 7 for melting and fixing the toner images transferred onto the sheet of paper 20 by light emitted from a flash lamp (not shown). Here is assumed an image forming apparatus 10 in which when an image is to be printed on a printing medium such as a sheet of paper 20, toner images corresponding to different color types of toner are color-by-color transferred onto the printing medium and fixed.

An operating panel 13 for setting conditions for printing an image on the printing medium such as a sheet of paper 20 is provided in a front portion of the image forming apparatus 10 shown in FIG. 1. When an operator (or user) operates the operating panel 13, the different color types of toner used for printing, the transferring and fixing sequence of the different color types of toner, the voltage (electric power) for driving the flash lamp of the fixing portion 7, and so on, are set in advance.

In more detail, when an image is to be printed on the printing medium such as a sheet of paper 20 by the image forming apparatus 10 shown in FIG. 1, the photoconductor drum 50 of the recording portion 5 is rotated clockwise so that a surface of the photoconductor drum 50 is evenly charged by a charger 52. Then, an optical system 4 exposes a pattern corresponding to information of image data on the surface of the photoconductor drum 50. As a result, an electrostatic latent image is formed on the photoconductor drum 50 in accordance with the image data (surface drawing data or line drawing data) to be printed on the sheet of paper 20. The electrostatic latent image formed on the photoconductor drum 50 is developed into a toner image by the development portion 3 by color of the different color types of toner disposed along the transport path of the sheet of paper 20.

Sheets of paper 20 continuously stored in a hopper portion 1 are transported to the transfer portion 6 by a paper transport unit 2. The toner image formed on the photoconductor drum 50 in accordance with the electrostatic latent image is continuously transferred onto the sheets of paper 20 by the transfer portion 6 by color of the different color types of toner. Incidentally, the toner image on the photoconductor drum 50 is transferred onto the sheets of paper 20 by a transfer charger (not shown) which is disposed in the transfer portion 6 so as to be opposite to the photoconductor drum 50 through the sheet of paper 20.

Then, each sheet of paper 20 having the toner image transferred thereon is irradiated with light emitted from the flash lamp (not shown) provided in the flash type fixing portion 7, so that the toner image is melted and fixed by the light. In this case, the toner image corresponding to one color type toner of the different color types of toners is fixed on each sheet of paper 20 by the series of printing steps. After completion of the fixing, each sheet of paper 20 is once ejected from the image forming apparatus 10 or stacked in a stacker portion 8. If it is required to form a color image having two or more colors by the image forming apparatus 10, the following procedure is performed. After the series of printing steps for a certain color is completed, the toner of the certain color set in the development portion 3 is replaced with another color of toner. The sheet of paper 20 on which the toner image of the certain color has been fixed is set on a hopper portion 1. Then, the series of printing steps for another color is performed. This procedure may be repeated in accordance with number of the color types of toners. As a result, we can obtain a color image formed on the sheet of paper 20 using the image forming apparatus 10.

On the other hand, after completion of the transferring, the surface of the photoconductor drum 50 is cleaned with a fur brush and a cleaning blade of a cleaning portion 9. After cleaning, the surface of the photoconductor drum 50 is discharged (i.e., destaticized) by a destaticizer (not shown) including a light-emitting diode (LED).

When the series of printing steps is further repeated by use of one and the same image forming apparatus 10, toner images corresponding to other color types of toner are fixed on each sheet of paper 20 successively.

In the image forming apparatus 10 according to the embodiment of the invention, the sequence of fixing of the toner images on the printing medium is set through the operating panel 13 or the like so that the different color types of toner can be superposed on one another in ascending (or descending) order of toner's absorptivity of the light (or toner's reflectivity of the light) emitted from the flash lamp. When the toner images are fixed on the printing medium in this order, the number of fixing of a color type of toner having low absorptivity of the light emitted from the flash lamp increases in accordance with the number of colors. For this reason, even the color type of toner having low absorptivity of the light emitted from the flash lamp can sufficiently absorb the energy of the light emitted from the flash lamp, so that lowering of fixing characteristic can be prevented from being caused by incomplete fixing of toner.

On the other hand, when the different color types of toner are fixed in ascending order of absorptivity of light emitted from the flash lamp (or in descending order of reflectivity of light), heat generated in the portion of toner images on the printing medium can be reduced so that partial shrinkage of the printing medium or shrinkage of molten toner can be suppressed. Accordingly, voids or transfer failure can be prevented from being caused by undulations or wrinkles of the printing medium.

More specifically, the image forming apparatus 10 according to the embodiment of the invention is configured so that a toner image corresponding to toner of a color (e.g., at least one color type toner selected from yellow toner, magenta toner and cyan toner) exhibiting low absorptivity of light emitted from the flash lamp (especially exhibiting low absorptivity for an infrared region of light emitted from the flash lamp) is fixed first, and that a toner image corresponding to black toner exhibiting high absorptivity for all regions of light emitted from the flash lamp is fixed second. Further, when all color types of toner, namely, yellow toner, magenta toner, cyan toner and black toner, are used at the time of fixing toner images on the printing medium, toner images corresponding to the four types of toner are fixed in order of yellow toner, magenta toner, cyan toner and black toner selected in ascending order of absorptivity of light emitted from the flash lamp (or in descending order of reflectivity of the light).

As described above, in the related art, color toner was fixed while the condition for fixing color toner exhibiting low absorptivity of light emitted from the flash lamp was set to be equal to the condition for fixing black toner. For this reason, color toner could not efficiently absorb energy of light emitted from the flash lamp when color toner was fixed. There was the possibility that fixing characteristic of color toner might be lowered.

On the contrary, in the image forming apparatus 10 according to the embodiment of the invention, the voltage (electric power) for driving the flash lamp is controlled so that the drive voltage for color toner is higher than the drive voltage for black toner when a toner image corresponding to color toner exhibiting low absorptivity of light emitted from the flash lamp is fixed. Accordingly, energy of light emitted from the flash lamp increases at the time of fixing color toner so that the color toner can efficiently absorb the energy of the light emitted from the flash lamp. Hence, when the voltage for driving the flash lamp is controlled so that the drive voltage for color toner is higher than the drive voltage for black toner while the fixing sequence of different color types of toner is determined so that color toner is fixed before black toner is fixed, fixing characteristic of color toner can be improved so greatly that the fixing characteristic of color toner can be kept substantially equal to that of black toner.

Furthermore, in the image forming apparatus 10 according to the embodiment of the invention, when a toner image corresponding to color toner exhibiting low absorptivity of light emitted from the flash lamp is fixed, the area rate (print rate) of the image may be set to be as high as possible while the fixing sequence of toner is determined so that color toner is fixed before black toner is fixed. Also in this case, color toner can efficiently absorb energy of light emitted from the flash lamp. Hence, the toner image on the printing medium can be melted and fixed evenly by heat generated by absorption of the light emitted from the flash lamp. Accordingly, fixing characteristic of color toner can be improved so greatly that the fixing characteristic of color toner can be kept substantially equal to that of black toner.

Figure 2:
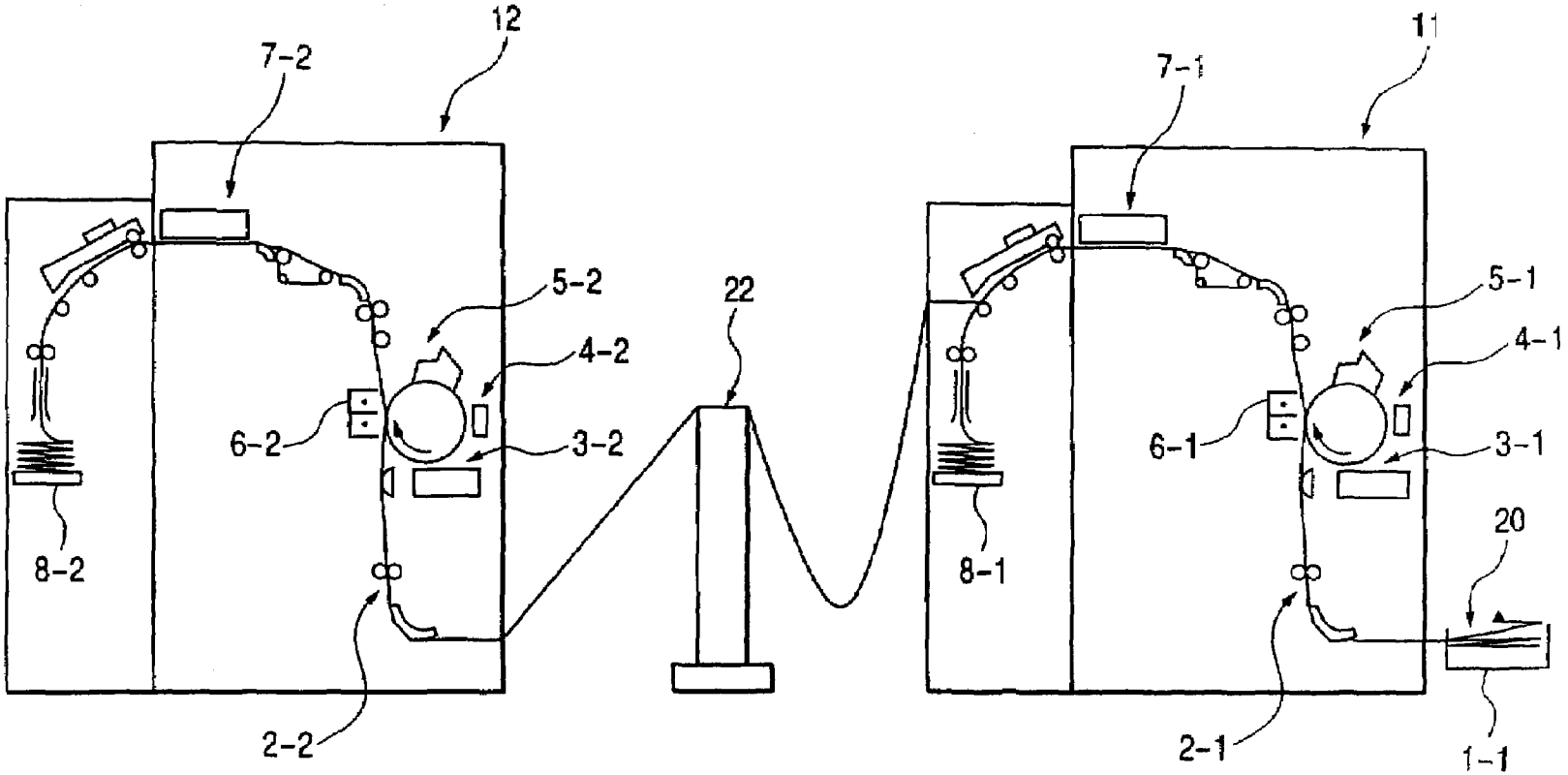
FIG. 2 is a schematic view showing the configuration of a combination type image forming apparatus according to an embodiment of the invention.

FIG. 2 is a schematic view showing the configuration of a combination type image forming apparatus according to an embodiment of the invention. Here is schematically shown the configuration of a combination type image forming apparatus in which two image forming units 11 and 12 such as two printers are combined with each other so that an image can be color-by-color printed on a printing medium such as a sheet of paper 20 in accordance with different color types of toner (e.g., two color types of toner). Incidentally, like numerals hereinafter refer to like constituent parts.

The embodiment shown in FIG. 2 is on the assumption that there are prepared two color types of toner, namely, color toner (e.g., at least one of yellow toner, magenta toner and cyan toner) exhibiting low absorptivity of light emitted from the flash lamp and black toner exhibiting high absorptivity of light emitted from the flash lamp, and that toner images are fixed on a printing medium in ascending order of toner's absorptivity of light. More specifically, the first image forming unit 11 is used for fixing color toner exhibiting low absorptivity of light before the second image forming unit 12 is used for fixing black toner exhibiting high absorptivity of light.

The configuration of each of the first and second image forming units 11 and 12 shown in FIG. 2 is substantially the same as that of the image forming apparatus 10 shown in FIG. 1. Incidentally, the first image forming unit 11 is different from the image forming apparatus 10 shown in FIG. 1 in that the sheet of paper 20 after completion of fixing of color toner is not stacked in a first stacker portion 8-1 but is ejected from the first image forming unit 11. On the other hand, the second image forming unit 12 is different from the image forming apparatus 10 shown in FIG. 1 in that the sheet of paper 20 after completion of fixing of black toner is not ejected from the second image forming unit 12 but is stacked in a second stacker portion 8-2. Further, a paper transport guide 22, which functions as a buffer at the time of transporting the sheet of paper 20, is provided between the first and second image forming units 11 and 12. The paper transport guide 22 is provided for smoothening the transport of the sheet of paper 20 by preventing slack in the sheet of paper 20 between the first and second image forming units 11 and 12.

The first image forming unit 11 shown in FIG. 2. includes, as main parts, a first development portion 3-1 for developing an electrostatic latent image formed on a photoconductor drum of a first recording portion 5-1, a first transfer portion 6-1 for transferring a toner image formed on the photoconductor drum in accordance with the electrostatic latent image developed by the first development portion 3-1 onto a sheet of paper 20, and a first flash type fixing portion 7-1 for melting and fixing the toner image transferred onto the sheet of paper 20 by light emitted from a flash lamp (not shown).

In more detail, in the first image forming unit 11 shown in FIG. 2, an image is printed on a printing medium such as a sheet of paper 20 as follows. The photoconductor drum of the first recording portion 5-1 is rotated clockwise so that a charger charges a surface of the photoconductor drum evenly. Then, a first optical system 4-1 exposes a pattern corresponding to information of image data on the surface of the photoconductor drum. As a result, an electrostatic latent image is formed on the photoconductor drum in accordance with the image data (inclusive of surface drawing data and line drawing data) to be printed on the sheet of paper 20. The electrostatic latent image formed on the photoconductor drum is developed into a toner image by the first development portion 3-1 using one type of color toner disposed along a transport path of the sheet of paper 20.

Sheets of paper 20 continuously stored in a first hopper portion 1-1 are successively fed to the first transfer portion 6-1 by a first paper transport unit 2-1. The toner image formed on the photoconductor drum in accordance with the color toner is continuously transferred onto each sheet of paper 20 by the first transfer portion 6-1. Incidentally, the toner image on the photoconductor drum is transferred onto the sheet of paper 20 by a transfer charger (not shown), which is disposed in the first transfer portion 6-1 so as to be opposite to the photoconductor drum through the sheet of paper 20.

Then, the sheet of paper 20 having the toner image corresponding to the color toner transferred thereon is irradiated with light emitted from a flash lamp (not shown) in the first fixing portion 7-1, so that the toner image is melted and fixed by the light. In this case, the toner image corresponding to one type of color toner is fixed on the printing medium by the series of printing steps. After completion of the fixing, the sheet of paper 20 is ejected from the first image forming unit 11 and transported to the second image forming unit 12 through the paper transport guide 22.

The second image forming unit 12 shown in FIG. 2 includes, as main parts, a second development portion 3-2 for developing an electrostatic latent image formed on a photoconductor drum of a second recording portion 5-2, a second transfer portion 6-2 for transferring a toner image formed on the photoconductor drum in accordance with the electrostatic latent image developed by the second development portion 3-2 onto the sheet of paper 20, and a second flash type fixing portion 7-2 for melting and fixing the toner image transferred onto the sheet of paper 20 by light emitted from a flash lamp (not shown).

In more detail, in the second image forming unit 12 shown in FIG. 2, an image is printed on a printing medium such as a sheet of paper 20 supplied from the paper transport guide 22 as follows. The photoconductor drum of the second recording portion 5-2 is rotated clockwise so that a charger charges a surface of the photoconductor drum evenly. Then, a second optical system 4-2 exposes a pattern corresponding to information of image data on the surface of the photoconductor drum. As a result, an electrostatic latent image is formed on the photoconductor drum in accordance with the image data to be printed on the sheet of paper 20. The electrostatic latent image formed on the photoconductor drum is developed into a toner image by the second development portion 3-2 using black toner disposed along a transport path of the sheet of paper 20.

The sheet of paper 20 supplied from the paper transport guide 22 is fed to the second transfer portion 6-2 by a second paper transport unit 2-2. The toner image corresponding to the black toner formed on the photoconductor drum is continuously transferred onto the sheet of paper 20 by the second transfer portion 6-2. Incidentally, the toner image on the photoconductor drum is transferred onto the sheet of paper 20 by a transfer charger (not shown), which is disposed in the second transfer portion 6-2 so as to be opposite to the photoconductor drum through the sheet of paper 20.

Then, the sheet of paper 20 having the toner image corresponding to the black toner transferred thereon is irradiated with light emitted from a flash lamp (not shown) in the second fixing portion 7-2, so that the toner image is melted and fixed by the light. In this case, the toner image corresponding to the black toner is fixed on the printing medium by the series of printing steps. Incidentally, because the toner image corresponding to the color toner fixed by the first fixing portion 7-1 has been already printed on the sheet of paper 20, the toner image of the black toner is fixed while superposed on the toner image of the color toner. After completion of fixing of the toner image of the black toner, the sheet of paper 20 is stacked in a second stacker portion 8-2.

As described above, in the embodiment shown in FIG. 2, the first and second image forming units 11 and 12 (constituting a combination type image forming apparatus) are arranged so that a toner image corresponding to color toner having low absorptivity of light emitted from the flash lamp (or color toner having high reflectivity of the light) is fixed first by the first image forming unit 11 and then a toner image corresponding to black toner having high absorptivity of the light (or black toner having low reflectivity of the light) is fixed finally by the second image forming unit 12. When the first and second image forming units 11 and 12 are operated successively for fixing the toner images on the sheet of paper 20, the toner image corresponding to color toner having low absorptivity of the light emitted from the flash lamp can be fixed repeatedly. Accordingly, even color toner having low absorptivity of the light emitted from the flash lamp can sufficiently absorb the energy of the light emitted from the flash lamp to thereby prevent lowering of fixing characteristic from being caused by poor fixing of color toner.

On the other hand, because a toner image corresponding to color toner having low absorptivity of light emitted from the flash lamp (or color toner having high reflectivity of the light) is fixed first, heat generated in the portion of the toner image (particularly, the black toner image) on the sheet of paper 20 can be suppressed. Accordingly, partial shrinkage of the sheet of paper 20 or shrinkage of molten toner can be suppressed to thereby prevent transfer missing or transfer failure from being caused by undulations or wrinkles of the sheet of paper 20.

Although the embodiment shown in FIG. 2 has been described on the case where two image forming units are combined into a combination type image forming apparatus for printing an image on a printing medium in accordance with two color types of toner, the invention is not limited to this apparatus configuration. For example, three or more image forming units may be combined into an image forming apparatus for printing an image on a printing medium in accordance with three or more color types of toner.

More specifically, when all four color types of toner, namely, yellow toner, magenta toner, cyan toner and black toner, are used at the time of fixing of toner images on a printing medium such as a sheet of paper, four image forming units may be combined into a combination type image forming apparatus so that toner images are color-by-color fixed in accordance with the sequence of yellow toner, magenta toner, cyan toner and back toner selected in ascending order of toner's absorptivity of light emitted from the flash lamp (or in descending order of toner's reflectivity of the light). When the four image forming units are operated successively for fixing the toner images on the printing medium, the number of fixings of toner having low absorptivity of light emitted from the flash lamp is increased. Accordingly, even toner having low absorptivity of light emitted from the flash lamp can sufficiently absorb the energy of the light emitted from the flash lamp, so that lowering of fixing characteristic can be prevented from being caused by poor fixing of toner.

Figure 3:
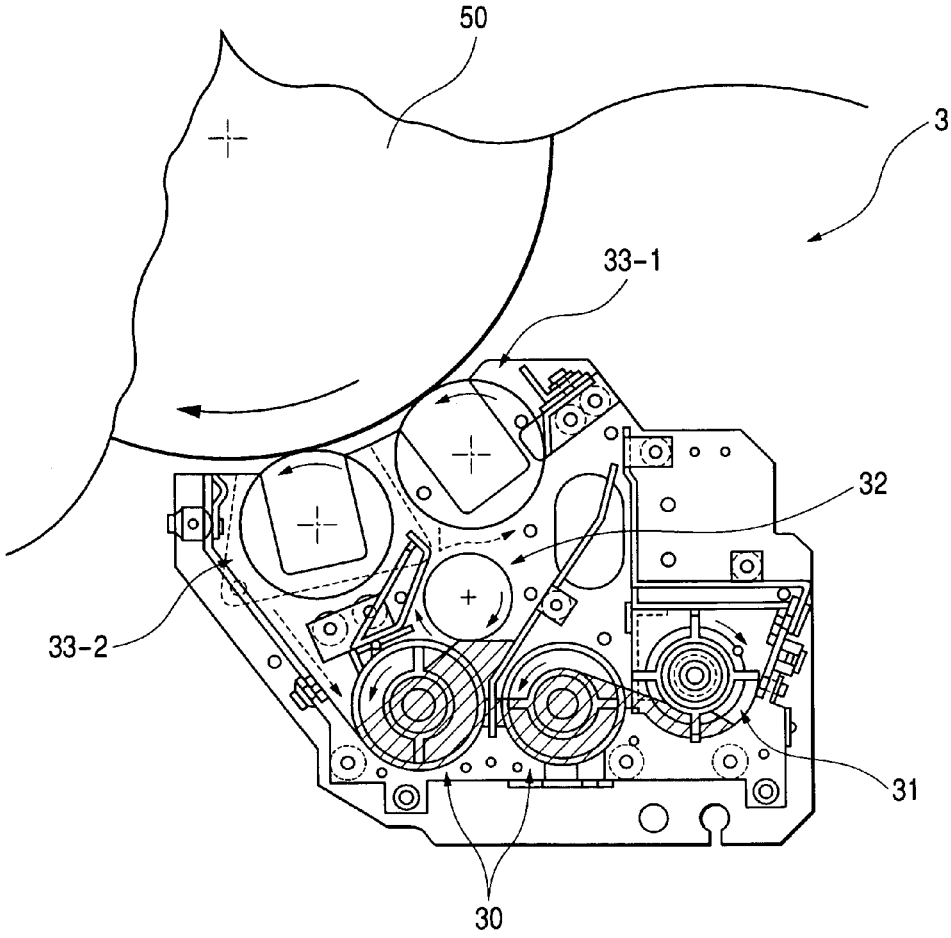
FIG. 3 is a front view showing the detailed configuration of a development portion in the image forming apparatus depicted in FIG. 1.

FIG. 3 is a front view showing the detailed configuration of the development portion in the image forming apparatus depicted in FIG. 1. The development portion 3 shown in FIG. 3 has a storage chamber for storing a developing agent (shown as a hatched portion in FIG. 3). Agitating screws 30, agitating paddle shafts 31, a conveyor roller 32 and magnet rollers 33-1 and 33-2 are disposed in the storage chamber.

Toner necessary for an image to be printed on the sheet of paper 20 (see FIG. 1) is also stored in the developing agent storage chamber. The developing agent and toner in the storage chamber are agitated by the agitating screws 30 and the agitating paddle shafts 31 and supplied to a surface of the photoconductor drum 50 via the conveyor roller 32 and the magnet rollers 33-1 and 33-2. An electrostatic latent image formed on the photoconductor drum 50 is developed by the developing agent and toner to thereby form a toner image corresponding to the toner. Incidentally, the configuration of each of the first and second development portions 3-1 and 3-2 in the combination type image forming apparatus shown in FIG. 2 is substantially the same as that of the development portion 3 shown in FIG. 3.

The relation between the fixing sequence of different color types of toner and the fixing characteristic of toner will be described in detail with reference to FIGS. 4 to 11.

Figure 4:
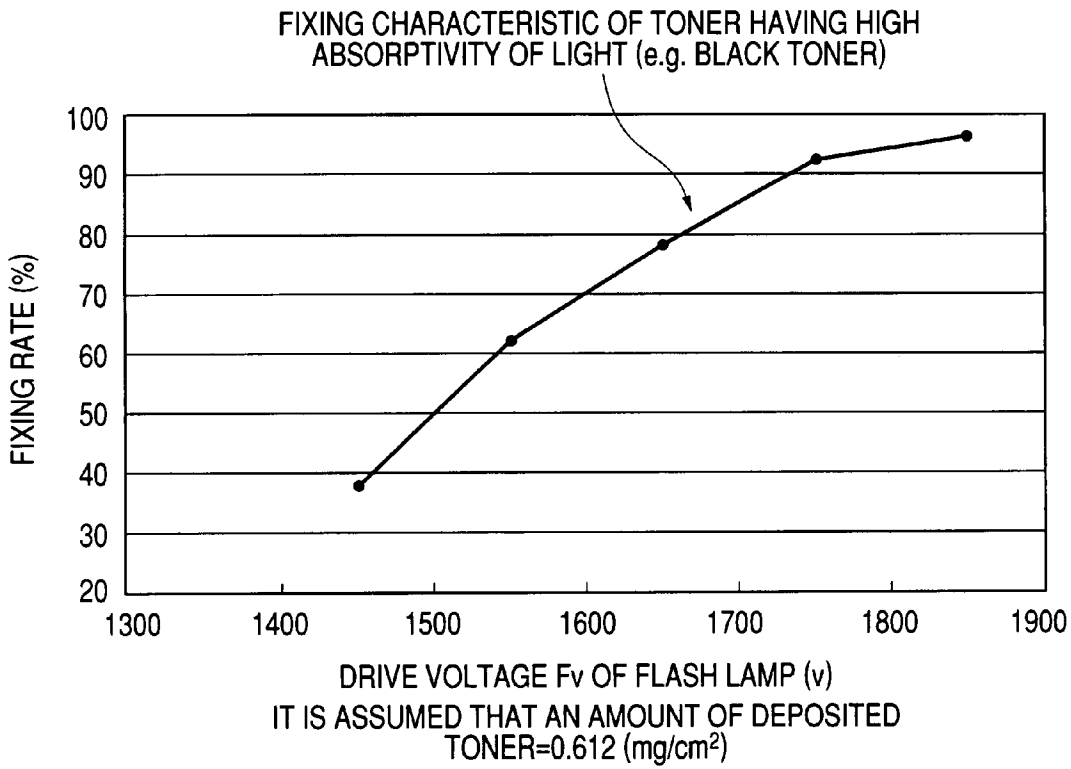
FIG. 4 is a graph showing change in fixing rate of toner having high absorptivity of light versus flash lamp drive voltage.

FIG. 4 is a graph showing change in fixing rate of toner having high absorptivity of light versus flash lamp drive voltage. Here is shown change in fixing characteristic (i.e., fixing rate) of black toner having high absorptivity of light versus drive voltage Fv as electric power of the flash lamp on the assumption that the amount (thickness) of black toner deposited on a surface of the printing medium is kept constant (e.g., the amount of deposited toner is 0.612 $mg/cm^2$). In this graph, flash lamp drive voltage Fv is expressed in volt (V) on the horizontal axis, and fixing rate of black toner is expressed in percentage (%) on the vertical axis.

Generally, the "fixing rate of toner" is measured as follows. Print density (optical density abbreviated as OD) of an image on a print surface on a printing medium is measured in advance. A tape is stuck onto the print surface of the printing medium. After the tape is peeled, print density of an image on the print surface is measured. The "fixing rate of toner" is defined as the rate of print density after peeling of the tape to print density before peeling of the tape. The "fixing rate of toner" is expressed as a relative value such as percentage (%).

It is obvious from the graph of FIG. 4 that the fixing rate of toner (e.g., black toner) increases as the energy of light increases in accordance with increase in the flash lamp drive voltage. This is because toner can sufficiently absorb the energy of light emitted from the flash lamp as the energy of light emitted from the flash lamp increases. To keep the fixing rate not lower than 90%, the flash lamp drive voltage Fv is set at 1850 V on the basis of the relation between the flash lamp drive voltage Fv and the fixing rate of toner as shown in the graph of FIG. 4.

Figure 5:
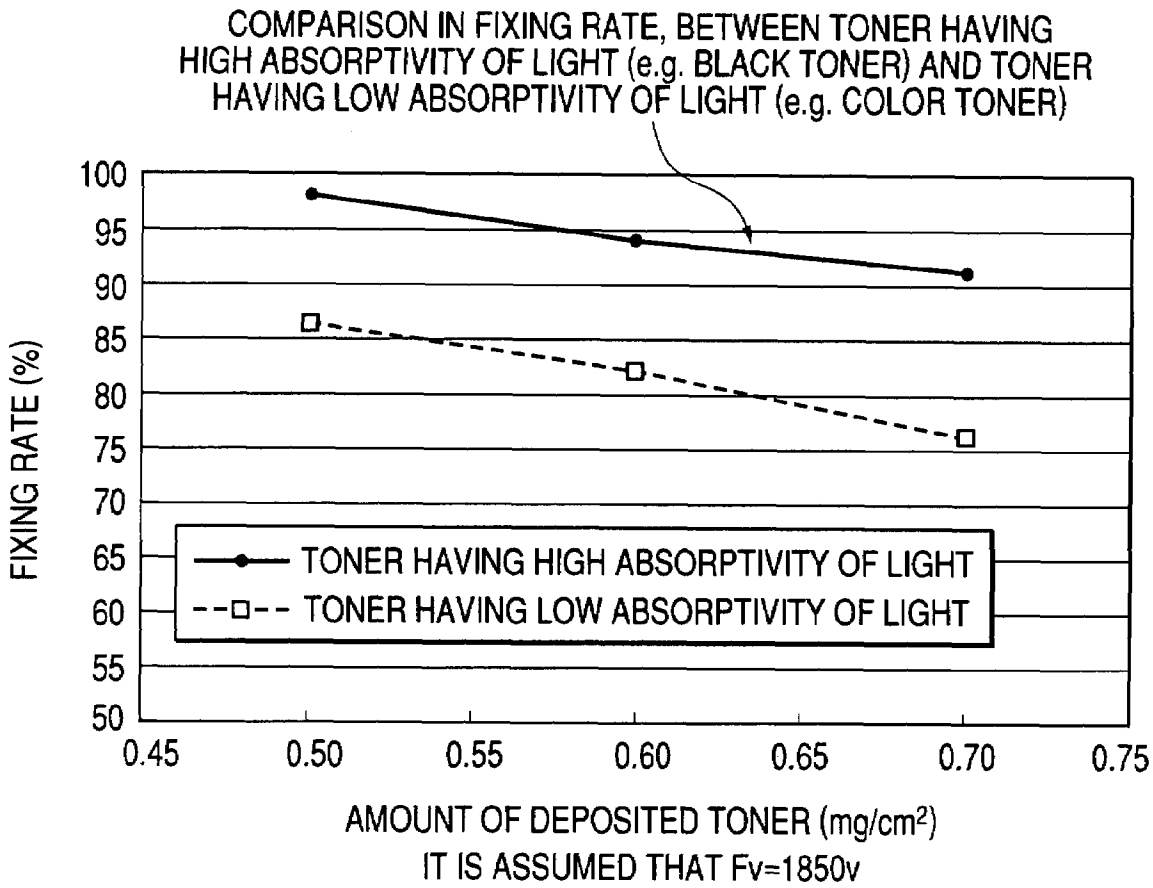
FIG. 5 is a graph showing results of comparison between the fixing rate of toner having high absorptivity of light and the fixing rate of toner having low absorptivity of light.

FIG. 5 is a graph showing results of comparison between the fixing rate of toner having high absorptivity of light and the fixing rate of toner having low absorptivity of light. The graph shows change in fixing rate versus amount of toner deposited on a surface of a printing medium for the purpose of comparison between two types of toner on the assumption that the flash lamp drive voltage is set at 1850 V. In FIG. 5, black toner having high absorptivity of light emitted from the flash lamp and color toner (e.g., magenta toner) having low absorptivity of light emitted from the flash lamp are selected as the two types of toner to be compared with each other.

It is obvious from the graph of FIG. 5 that the fixing rate of each of black toner and color toner decreases as the amount of toner deposited on the printing medium surface increases. The fixing rate of black toner having high absorptivity of light is, however, kept not lower than 90% even in the case where the amount of deposited toner increases to about 0.7 $mg/cm^2$. On the other hand, the fixing rate of color toner having low absorptivity of light is lower than the fixing rate of black toner. Particularly when the amount of deposited toner increases to about 0.7 $mg/cm^2$, the fixing rate of color toner is reduced remarkably to be lower than 80%. This is because color toner originally has a tendency that it cannot sufficiently absorb the energy of light emitted from the flash lamp compared with black toner, and because this tendency becomes remarkable as transmittivity of light decreases in accordance with increase in the amount (thickness) of deposited toner.

Figure 6:
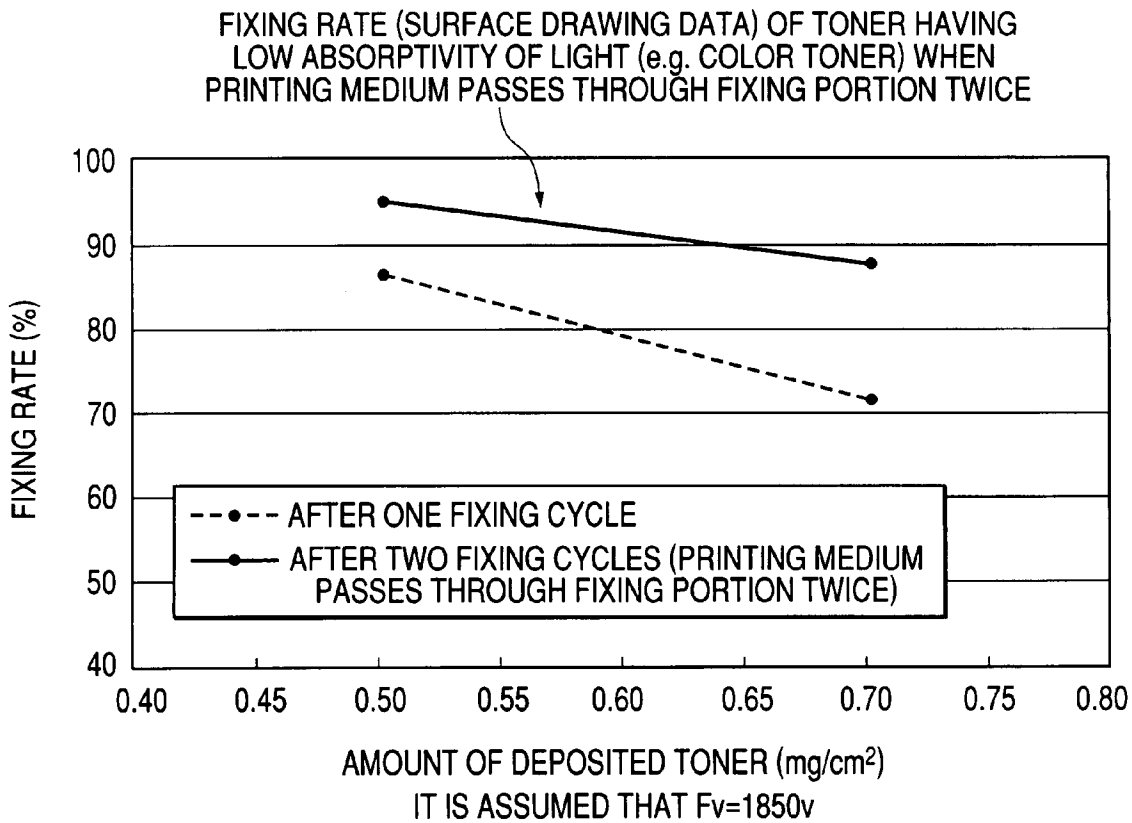
FIG. 6 is a graph showing change in fixing rate of surface drawing data of toner having low absorptivity of light versus amount of deposited toner after one fixing cycle or two fixing cycles.

FIG. 6 is a graph showing change in fixing rate of surface drawing data of toner having low absorptivity of light versus amount of deposited toner after one fixing cycle or two fixing cycles. The graph shows change in fixing rate of surface drawing data of color toner (e.g., magenta toner) having low absorptivity of light after one fixing cycle or two fixing cycles on the assumption that the flash lamp drive voltage is set at 1850 V.

It is obvious from the graph of FIG. 6 that the fixing rate of surface drawing data of color toner having low absorptivity of light takes a low value in a range of from about 70% to about 80% after one fixing cycle is performed in the fixing portion to form surface drawing data on the printing medium. However, when color toner having low absorptivity of light is fixed first and black toner having high absorptivity of light is fixed finally as described above in the embodiment shown in FIG. 2, the second fixing cycle is performed for the color toner in a state in which surface drawing data is not formed on the printing medium. After the second fixing cycle is completed (i.e., the printing medium passes through the fixing portion twice), the fixing rate of surface drawing data of the color toner increases to about 90% which is equal to the fixing rate of black toner because the color toner sufficiently absorbs light emitted from the flash lamp.

Figure 7:
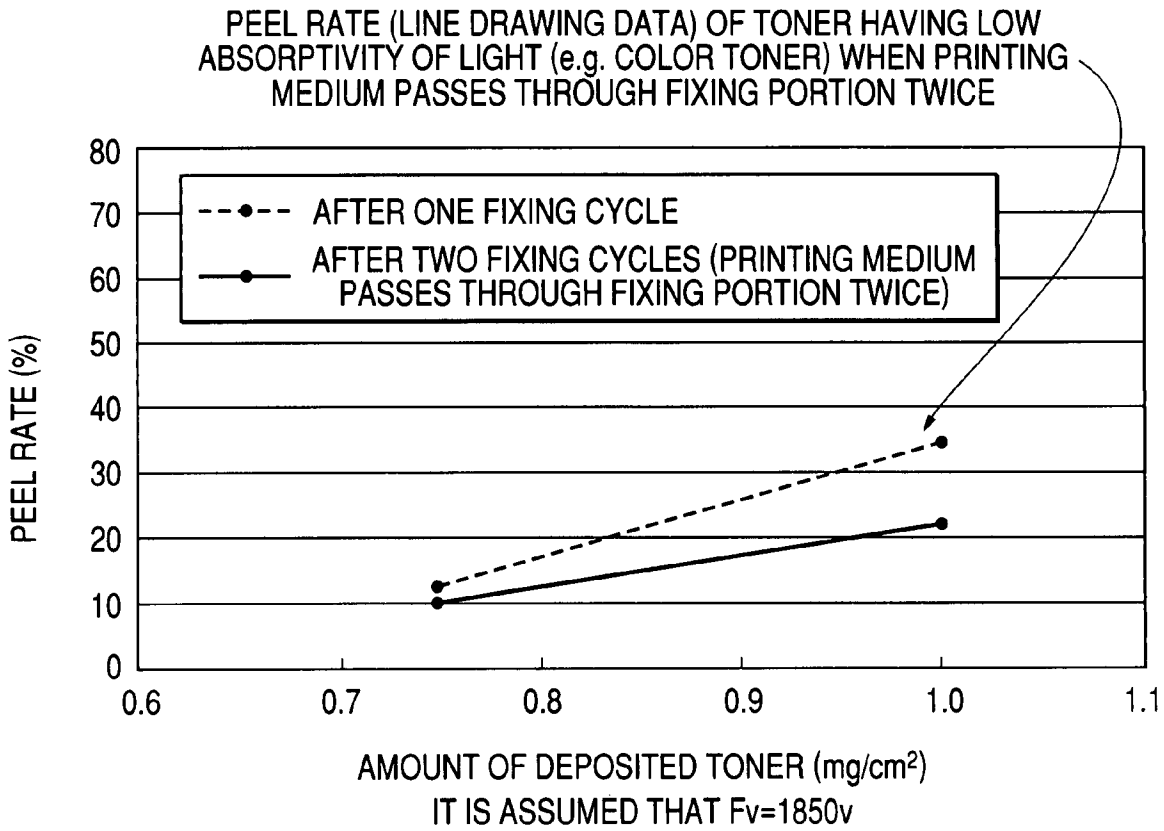
FIG. 7 is a graph showing change in peel rate of line drawing data of toner having low absorptivity of light versus amount of deposited toner after one fixing cycle or two fixing cycles.

FIG. 7 is a graph showing change in peel rate of line drawing data of toner having low absorptivity of light versus amount of deposited toner after one fixing cycle or two fixing cycles. The graph shows change in peel rate of line drawing data of color toner (e.g. ,magenta toner) having low absorptivity of light after one fixing cycle or two fixing cycles on the assumption that the flash lamp drive voltage is set at 1850 V.

Generally, the "peel rate of toner" is measured as follows. The area percentage of line drawing data on a printing medium sample is measured in advance. A tape is stuck onto the printing medium sample. After the tape is peeled, the area percentage of line drawing data deposited on the tape surface is measured. The "peel rate of toner" is defined as the rate of the area percentage of line drawing data on the tape surface to the area percentage of line drawing data before peeling of the tape. The "peel rate of toner" is expressed as a relative value such as percentage (%).

It is obvious from the graph of FIG. 7 that the peel rate of line drawing data of color toner having low absorptivity of light takes a high value in a range of from about 20% to about 30% after one fixing cycle is performed in the fixing portion to form line drawing data on the printing medium. However, when color toner having low absorptivity of light is fixed first and black toner having high absorptivity of light is fixed finally as described above in the embodiment shown in FIG. 2, the second fixing cycle is performed for the color toner in a state in which line drawing data is not formed on the printing medium. After the second fixing cycle is completed (i.e., the printing medium passes through the fixing portion twice), the peel rate of line drawing data of the color toner decreases to about 10% which is equal to the peel rate of black toner because the color toner sufficiently absorbs light emitted from the flash lamp.

Figure 8:
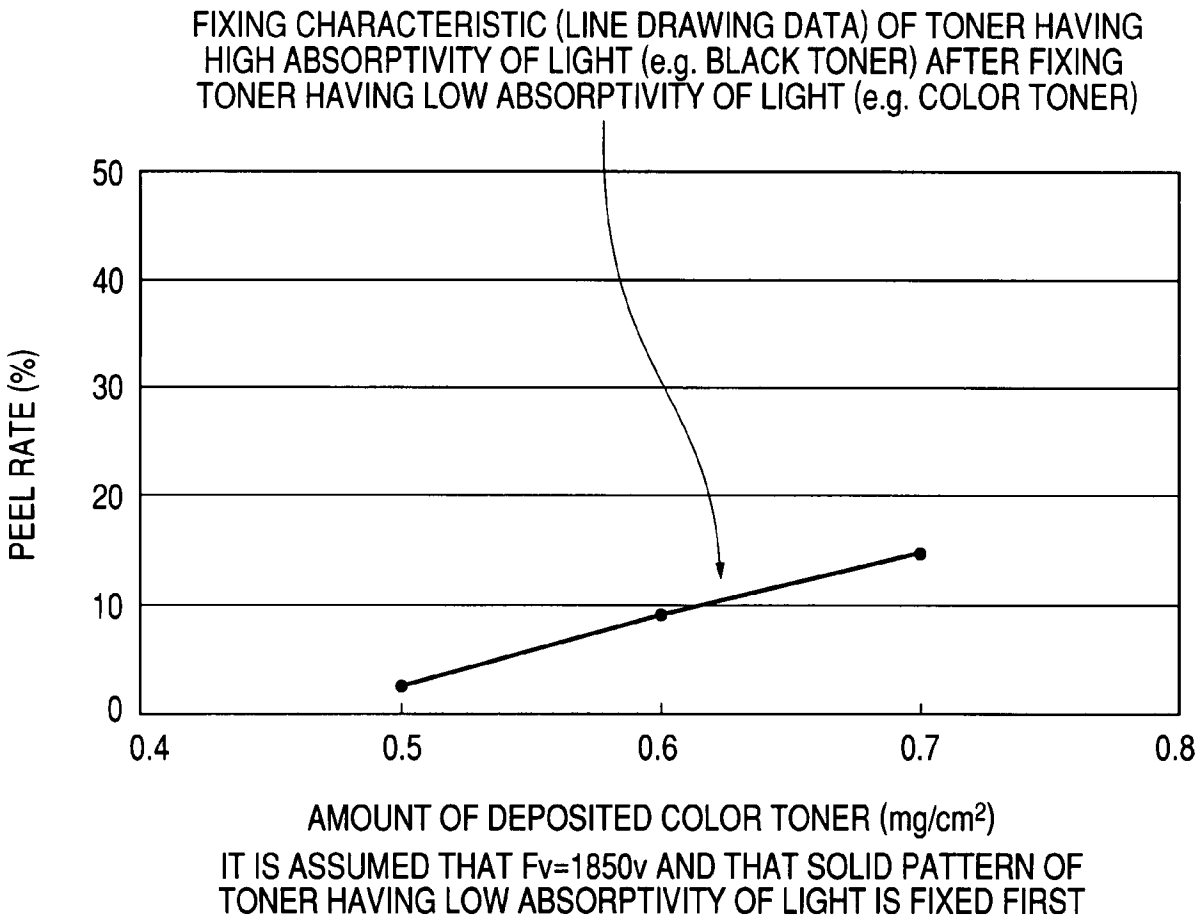
FIG. 8 is a graph showing change in peel rate of line drawing data of toner having high absorptivity of light after fixing of toner having low absorptivity of light.

FIG. 8 is a graph showing change in peel rate of line drawing data of toner having high absorptivity of light after fixing of toner having low absorptivity of light. The graph shows change in peel rate of line drawing data of black toner versus amount of deposited color toner in the case where a solid pattern of color toner (e.g., magenta toner) having low absorptivity of light is fixed first and line drawing data of black toner having high absorptivity of light is fixed finally on the assumption that the flash lamp drive voltage is set at 1850 V.

It is obvious from the graph of FIG. 8 that the peel rate of line drawing data of black toner having high absorptivity of light increases as the amount (thickness) of the deposited solid pattern of color toner having low absorptivity of light increases. Accordingly, even in the case where color toner having low absorptivity of light is fixed first, the peel rate of line drawing data of black toner becomes 10% or higher if the amount of deposited color toner increases to about 0.7 mg/cm$^2$. As a result, the effect in fixing toner images in ascending order of toner's absorptivity of light is lowered.

Figure 9:
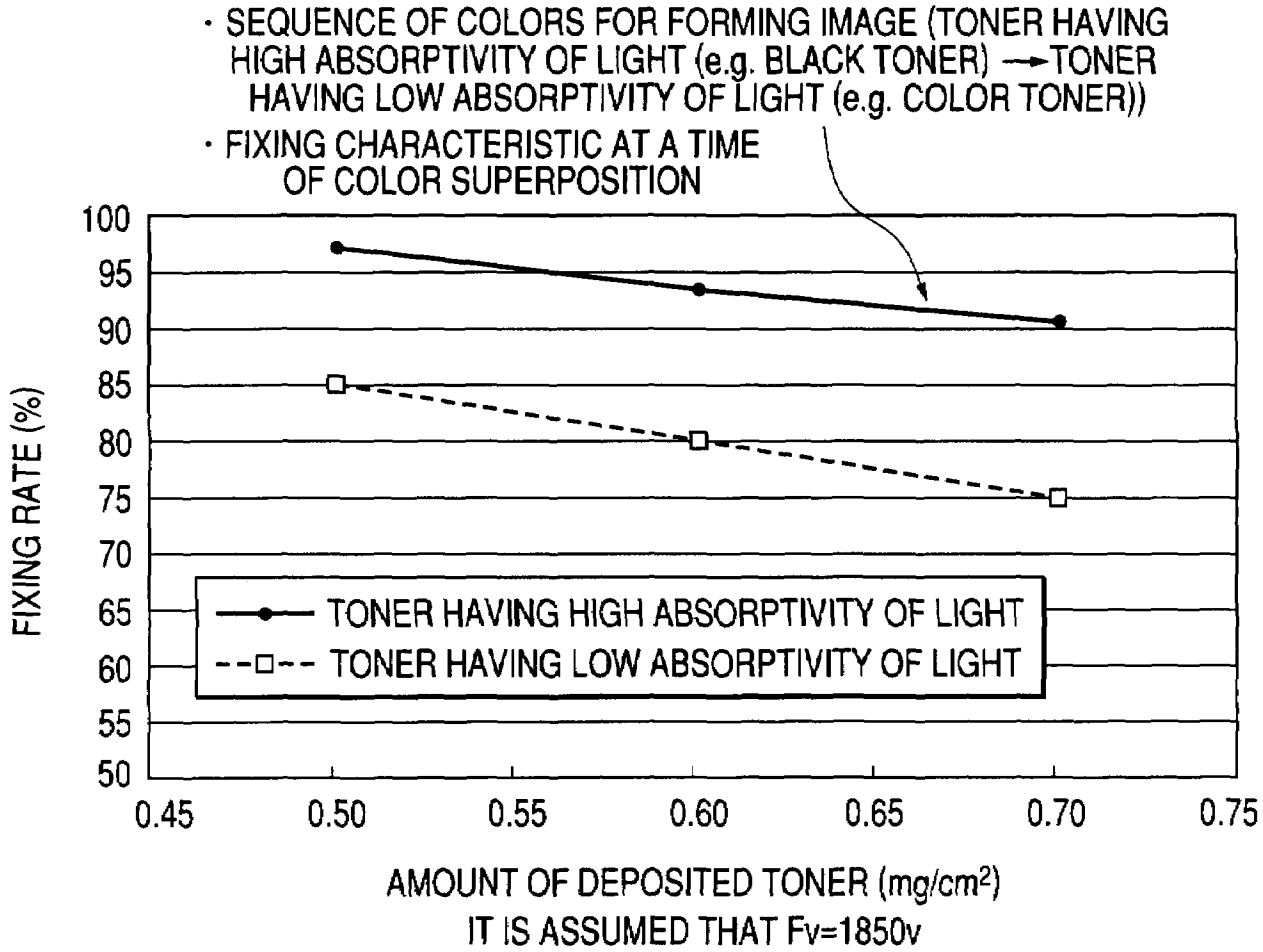
FIG. 9 is a graph showing fixing characteristic of each color type of toner at color superposition in the case where the sequence of colors for forming a color image is decided so that toner having high absorptivity of light is used as first toner and that toner having low absorptivity of light is used as second toner.
Figure 10:
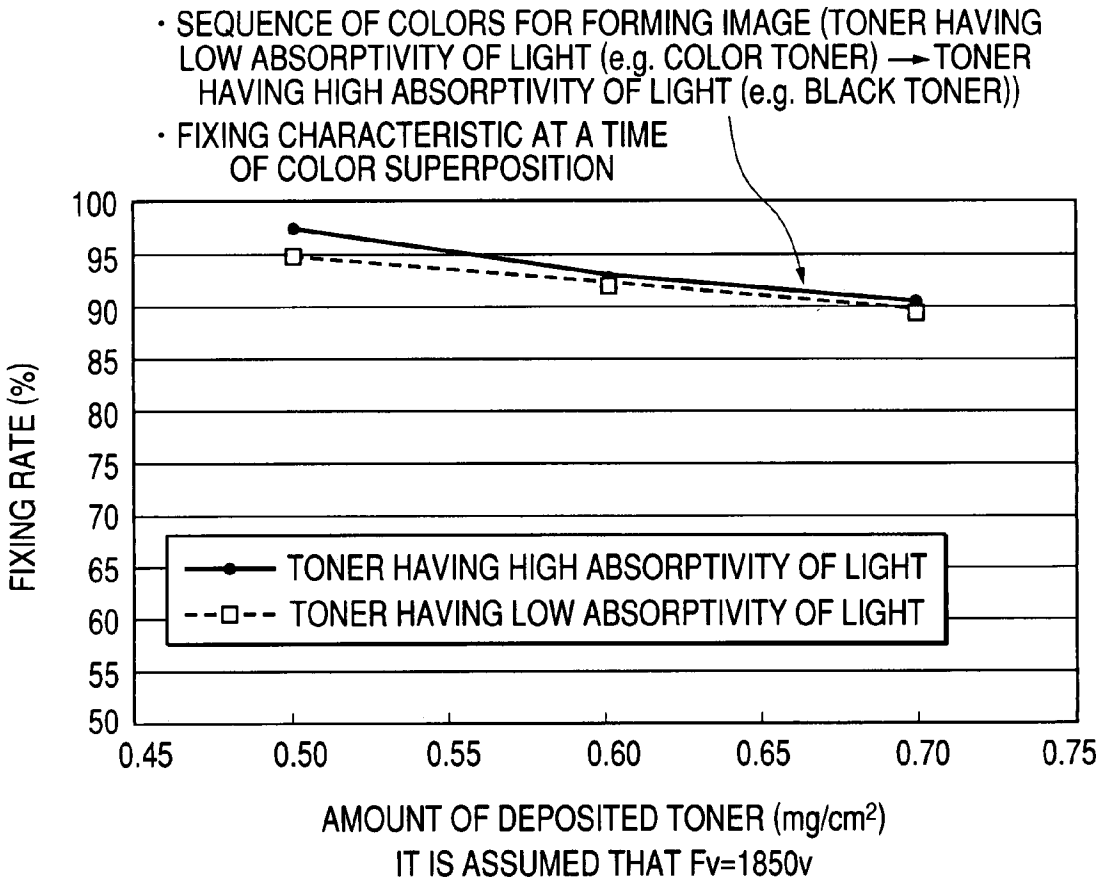
FIG. 10 is a graph showing fixing characteristic of each color type of toner at color superposition in the case where the sequence of colors for forming a color image is decided so that toner having low absorptivity of light is used as first toner and that toner having high absorptivity of light is used as second toner.

FIG. 9 is a graph showing fixing characteristic of each color type of toner at color superposition in the case where the sequence of colors for forming a color image is determined so that toner having high absorptivity of light is used as first toner and that toner having low absorptivity of light is used as second toner. FIG. 10 is a graph showing fixing characteristic of each color type of toner at color superposition in the case where the sequence of colors for forming a color image is determined so that toner having low absorptivity of light is used as first toner and that toner having high absorptivity of light is used as second toner. Each of the graphs shown in FIGS. 9 and 10 shows results of comparison in change in fixing rate between two types of toner in accordance with the fixing sequence of the two types of toner on the assumption that the flash lamp drive voltage is set at 1850 V.

In more detail, the graph of FIG. 10 shows change in fixing rate of each of color toner and black toner versus amount of deposited toner in the case where color toner (e.g., magenta toner) having low absorptivity of light is fixed first and black toner having high absorptivity of light is fixed finally in the same manner as in the embodiment shown in FIG. 2. Contrary to the case for FIG. 10, the graph of FIG. 9 shows change in fixing rate of each of color toner and black toner versus amount of deposited toner in the case where black toner having high absorptivity of light is fixed first and color toner (e.g., magenta toner) having low absorptivity of light is fixed finally. For example, the case shown in FIG. 9 may occur because there is no consideration of the fixing sequence of two types of toner in the related-art image forming apparatus.

As shown in FIG. 9, in the case where black toner having high absorptivity of light is fixed first and color toner having low absorptivity of light is fixed finally, fixing of color toner having low absorptivity of light is performed only once. Accordingly, in the graph of FIG. 9, the fixing rate of black toner is kept not lower than about 90% but the fixing rate of color toner is reduced remarkably to be lower than 80% when the amount of deposited toner increases to about 0.7 mg/cm$^2$.

On the other hand, when color toner having low absorptivity of light is fixed first and black toner having high absorptivity of light is fixed finally as shown in FIG. 10, fixing of color toner having low absorptivity of light is performed twice. Accordingly, in the graph of FIG. 10, the fixing rate of each of black toner and color toner is kept not lower than about 90% even when the amount of deposited toner increases to about 0.7 mg/cm$^2$. In other words, when toner images are fixed in ascending order of toner's absorptivity of light emitted from the flash lamp, lowering of the fixing rate of color toner having low absorptivity of light can be prevented being caused by poor fixing of color toner.

Figure 11:
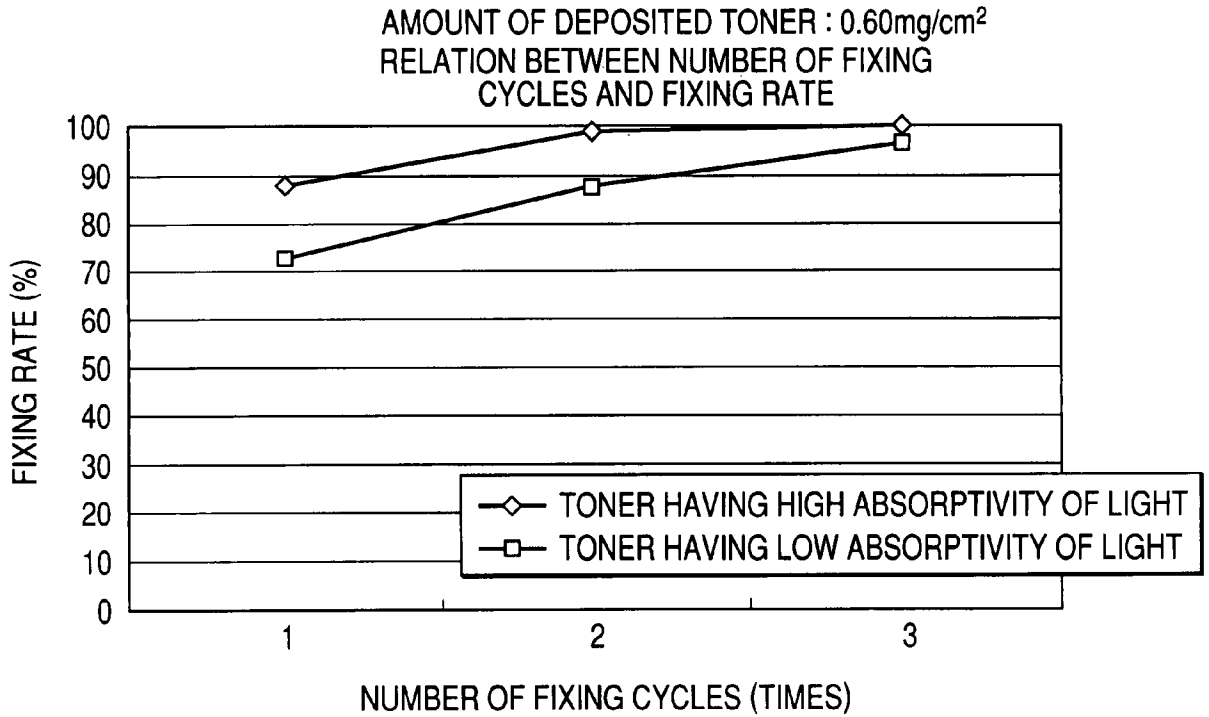
FIG. 11 is a graph showing the relation between fixing rate and number of toner fixing cycles.

FIG. 11 is a graph showing the relation between the fixing rate of toner and the number of fixing cycles. The graph shows change in fixing rate versus the number of fixing cycles in a color toner sample (e.g., magenta toner) and a black toner sample in the case where a printer PS2400A (available on the market) is used as an image forming apparatus and a spectral calorimeter X-Rite (available on the market) is used as a device for measuring the fixing rate of toner. In this case, the amount of deposited toner in each sample is set at 0.60 mg/cm$^2$ and the number of emissions of light from the flash lamp is regarded as the number of fixing cycles. Incidentally, for reference, the actually measured fixing rates (expressed in %) obtained by the spectral calorimeter X-Rite are shown in the upper right of FIG. 11.

It is obvious from the graph of FIG. 11 that it is impossible to obtain a sufficient fixing rate of color toner having low absorptivity of light emitted from the flash lamp when the number of emissions of light from the flash lamp is only one because the fixing rate allowed to be kept is about 70%. However, when the number of emissions of light from the flash lamp increases to at least two, the fixing rate of color toner can be kept substantially equal to that of black toner because the fixing rate of color toner increases to about 90%.

A mechanism for fixing toner by heat of light emitted from the flash lamp will be described below in detail with reference to FIGS. 12 to 14.

Figure 12:
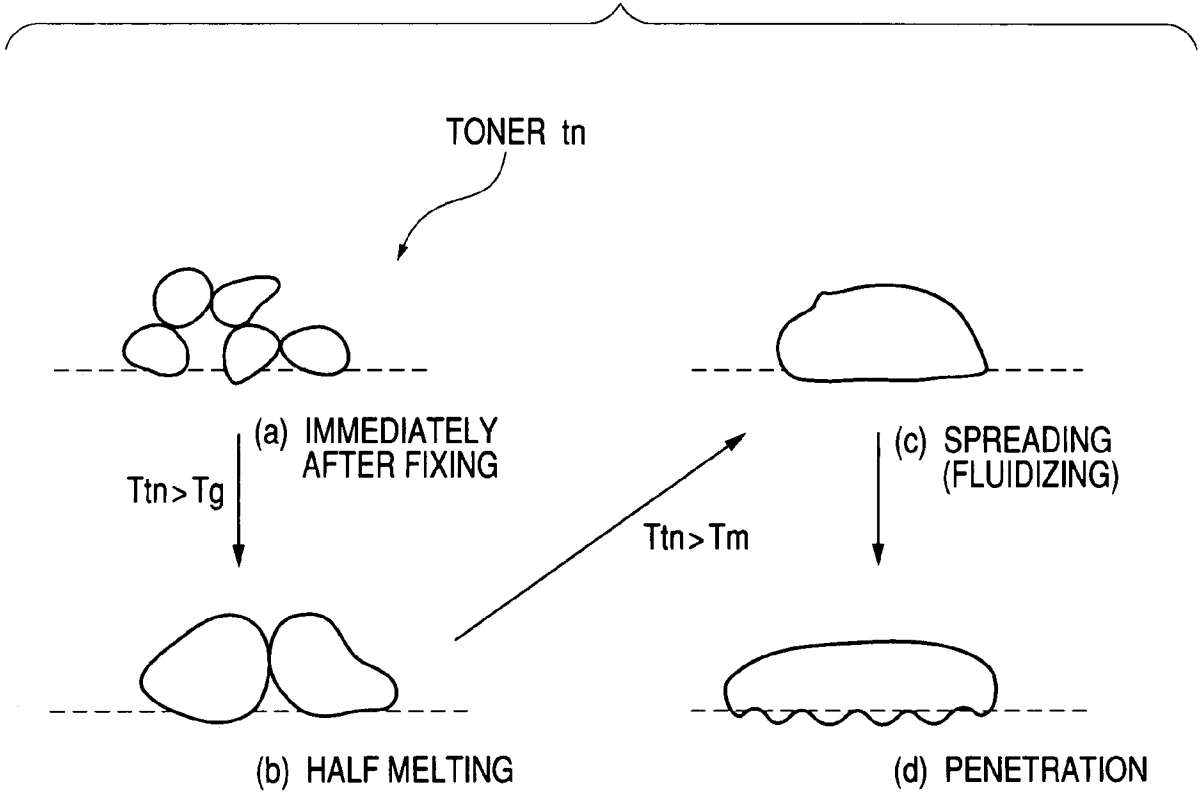
FIG. 12 is a typical view showing change in form of toner receiving energy of light.

FIG. 12 is a typical view showing change in form of toner receiving energy of light. FIG. 13 is a graph showing change in visco-elasticity of toner in accordance with increase in toner temperature. FIG. 14 is a graph showing an example of absorption spectra of black toner and heat-roller color toner and an emission spectrum of the flash lamp. In FIG. 13, the horizontal axis shows toner temperature Ttn, and the vertical axis shows a dynamic shear modulus expressing the visco-elasticity of toner in logarithmic scale. Generally, the toner temperature Ttn is expressed in ° C., and the dynamic shear modulus is expressed in dyn/cm$^2$.

Generally, immediately after a toner image corresponding to each of different color types of toner tn is irradiated with light (particularly, infrared light) emitted from the flash lamp so that the toner image is fixed on a printing medium such as a sheet of paper, the toner is deposited in the vitreous state on the printing medium as shown in the state (a) of FIG. 12. In this state, as shown in the graph of FIG. 13, the visco-elasticity of the toner tn is so high that the dynamic shear modulus of the toner tn takes a relatively large value. When the toner tn then absorbs the energy of the light emitted from the flash lamp so that the toner temperature Ttn is higher than the glass transition point Tg (Ttn>Tg), the visco-electricity of the toner is reduced so that the state of the toner changes to a rubbery region (half-melted state) as shown in the state (b) of FIG. 12 and FIG. 13.

Figure 13:
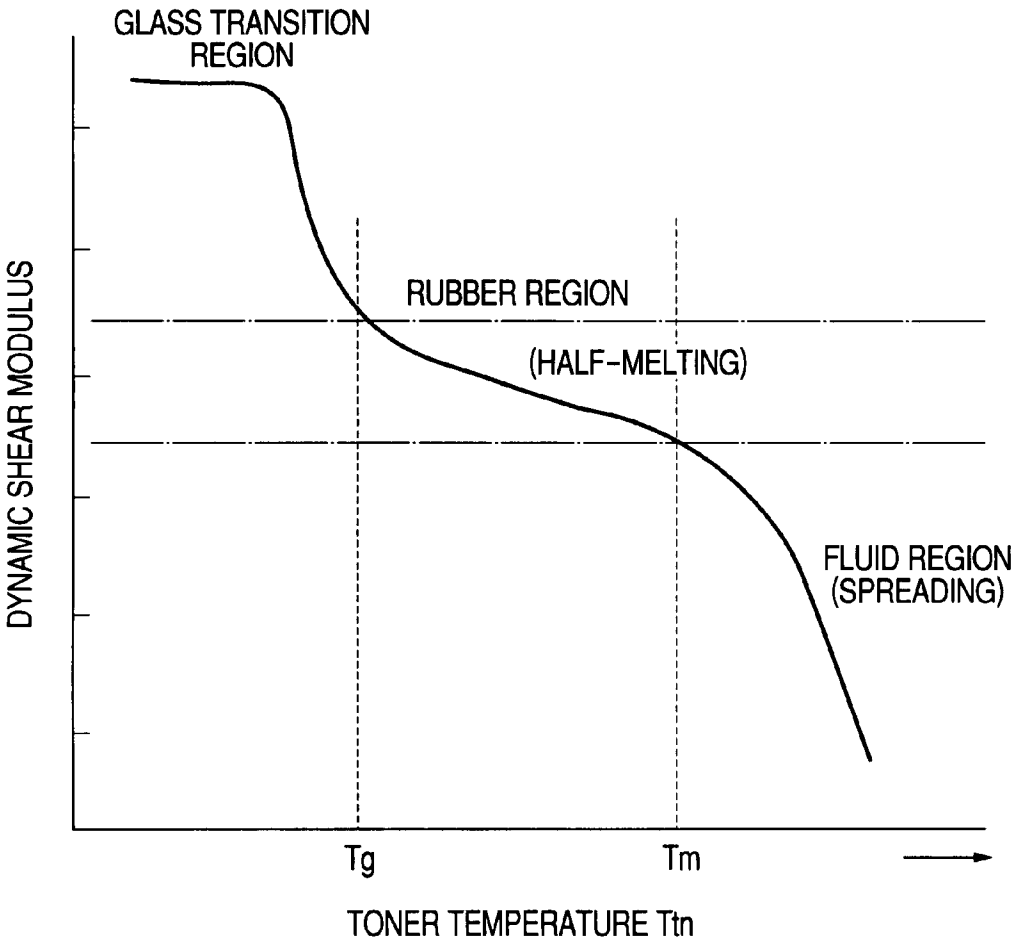
FIG. 13 is a graph showing change in visco-elasticity of toner in accordance with increase in toner temperature.

When the toner temperature Ttn is further higher than the melting point Tm (Ttn>Tm), the visco-electricity of the toner tn is further reduced so that the state of the toner tn changes from the rubbery region to a fluid region (spread state) as shown in the state (c) of FIG. 12 and FIG. 13. In this state, the toner tn penetrates into fiber in the sheet of paper so that the toner image is fixed as shown in the state (d) of FIG. 12 and FIG. 13. If the intensity of light emitted from the flash lamp is too high, particularly the temperature of the inside of the toner may increase so rapidly that the toner gets in a void state because the toner is exploded before the visco-elasticity of the toner is reduced.

Figure 14:
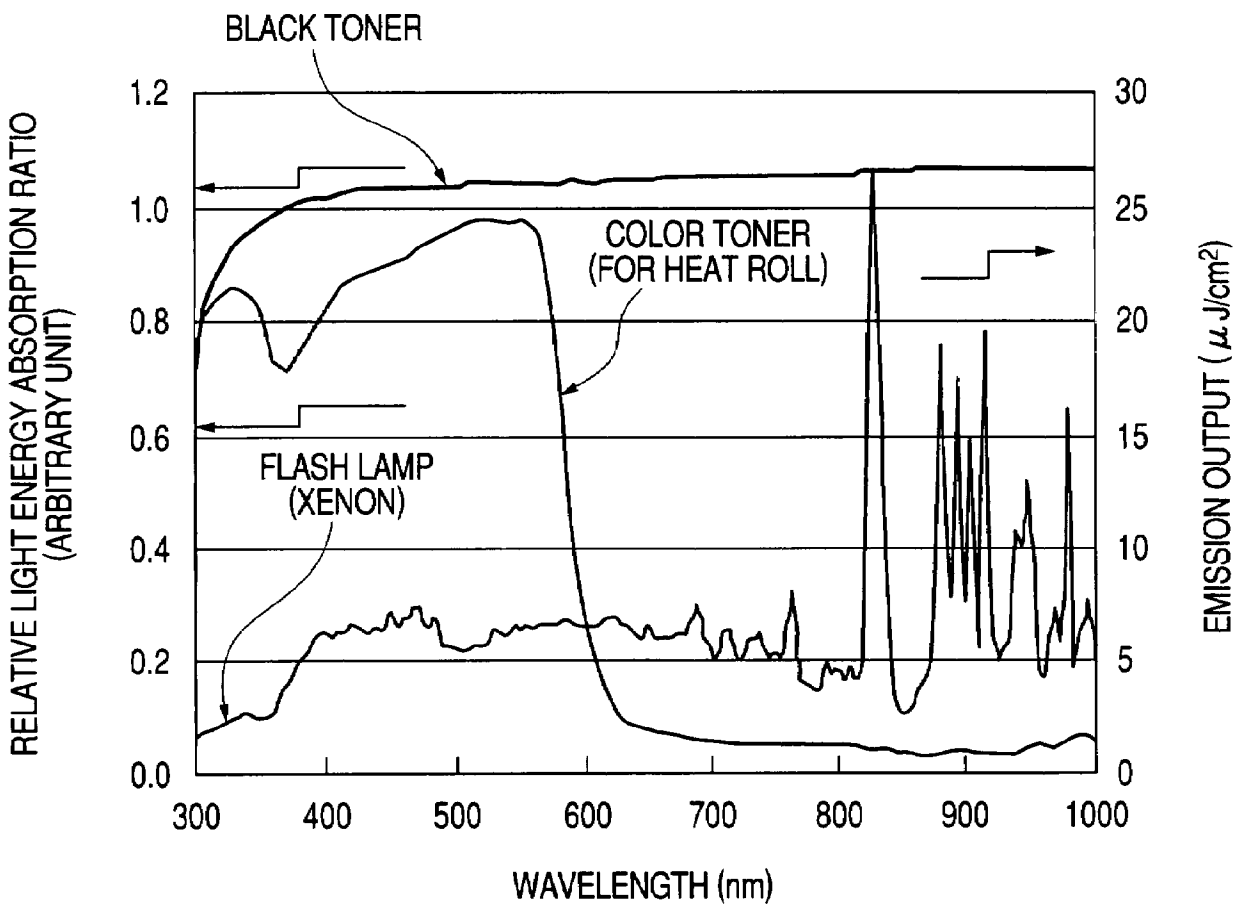
FIG. 14 is a graph showing an example of absorption spectra of black toner and heat-roller color toner and an emission spectrum of a flash lamp.

As shown in FIG. 14, when the emission spectrum of the flash lamp filled with rare gas such as xenon (Xe) gas is expressed in a curve of wavelength versus emission output (J/cm$^2$), the emission spectrum generally exhibits no peak of the emission output in the visible region and exhibits the highest intensity of emission at an infrared wavelength of 830 nm and an intermittent bright-line spectrum in a region of from 880 nm to 1000 nm.

When black toner is fixed by use of a laser printer for forming a monochrome image, the black toner absorbs the energy of light for all wavelength regions of the light emitted from the flash lamp (i.e., the black toner has light energy absorptance substantially constant in all wavelength regions of light emitted from the flash lamp) as represented by the absorption spectrum of black toner in FIG. 14. For this reason, sufficient fixing can be generally performed even in the case where the number of emissions of light from the flash lamp is only one. On the contrary, flash type fixing cannot be performed for color toner used in heat-roller type fixing because the toner's absorptivity of light is very low for the infrared region of 800 nm or higher in which the intensity of light emitted from the flash lamp is relatively high, as represented by the absorption spectrum of color toner in FIG. 14.

Therefore, there may be used a method in which an infrared-absorbing agent is added to color toner used for flash type fixing so that the color toner has absorption characteristic for the infrared region of 800 nm or higher in light emitted from the flash lamp.

If the amount of the added infrared-absorbing agent is too large, color toner, however, becomes turbid because the infrared-absorbing agent is generally colored. Therefore, color toner such as yellow toner, which must be as bright as possible, is generally used in the condition that the amount of the added infrared-absorbing agent is suppressed.

On the market for POD (Point of Development), there is an increasing demand not only for a monochrome laser printer for forming a monochrome image but also for two or three spot colors. The amount of the infrared-absorbing agent added to color toner used in such a printer is controlled to make the range of color reproduction as wide as possible. As a result, when the number of emissions of light from the flash lamp is limited to only one, fixing of the color toner is too insufficient to obtain a good fixing rate of not lower than 90%. It is therefore necessary to set the number of emissions of light from the flash lamp to be at least two as described above with reference to FIG. 11 in order to obtain sufficient fixing of the color toner.

In other words, black toner can be fixed sufficiently even in the case where the number of emissions of light from the flash lamp is only one, whereas color toner such as magenta toner cannot be fixed sufficiently when the number of emissions of light from the flash lamp is only one. When the number of emissions of light from the flash lamp is at least two, a required fixing rate of color toner can be obtained. On the other hand, when black toner is irradiated with light by three times, shines or voids are generated in the toner image after fixing. It is therefore necessary to fix black toner after fixing of color toner to thereby suppress the generation of shines or voids.

As described above, when a combination type image forming apparatus (see FIG. 2) is disposed so that toner images are fixed in ascending order of toner's absorptivity of light emitted from the flash lamp so that color toner is fixed first and that black toner is fixed finally, a sufficient fixing rate of each of color toner and black toner can be ensured and good printing can be obtained so that shines or voids are not generated in the image on the printing medium.

Figure 15:
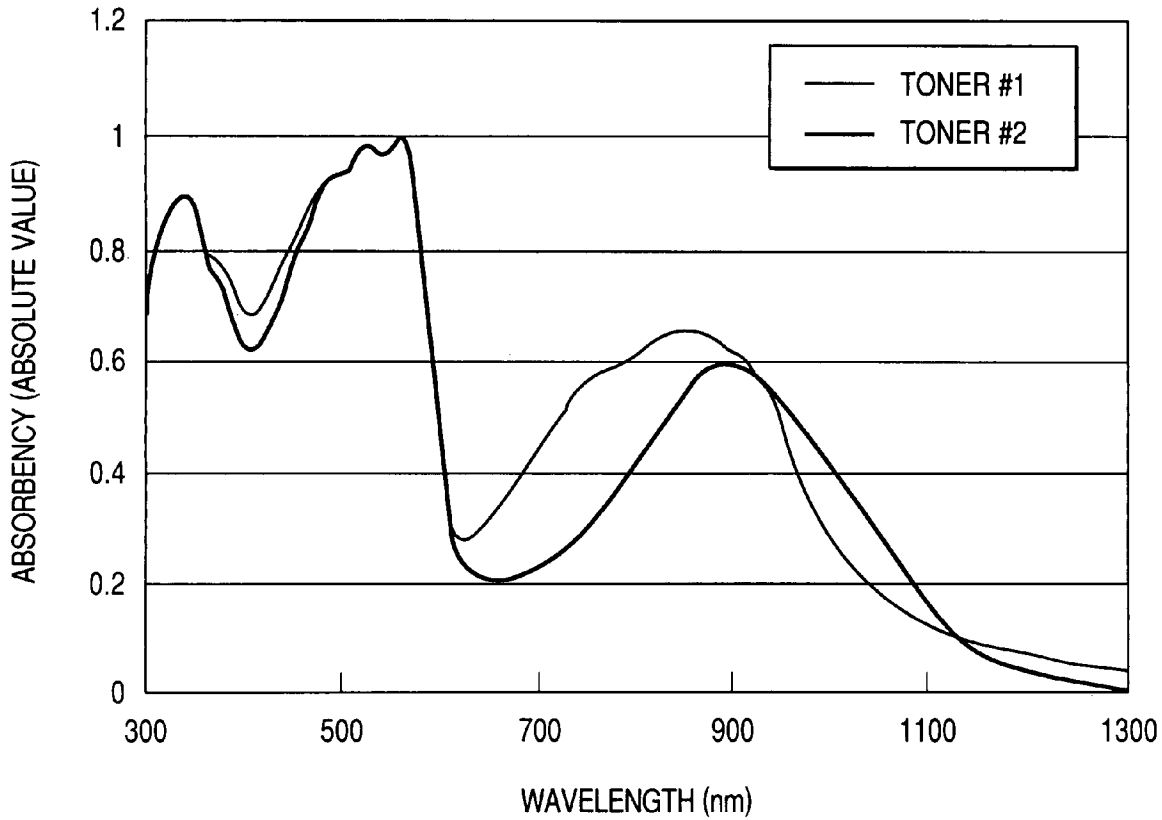
FIG. 15 is a graph showing the relation between absorption wavelength and kind of infrared-absorbing agent.
Figure 16:
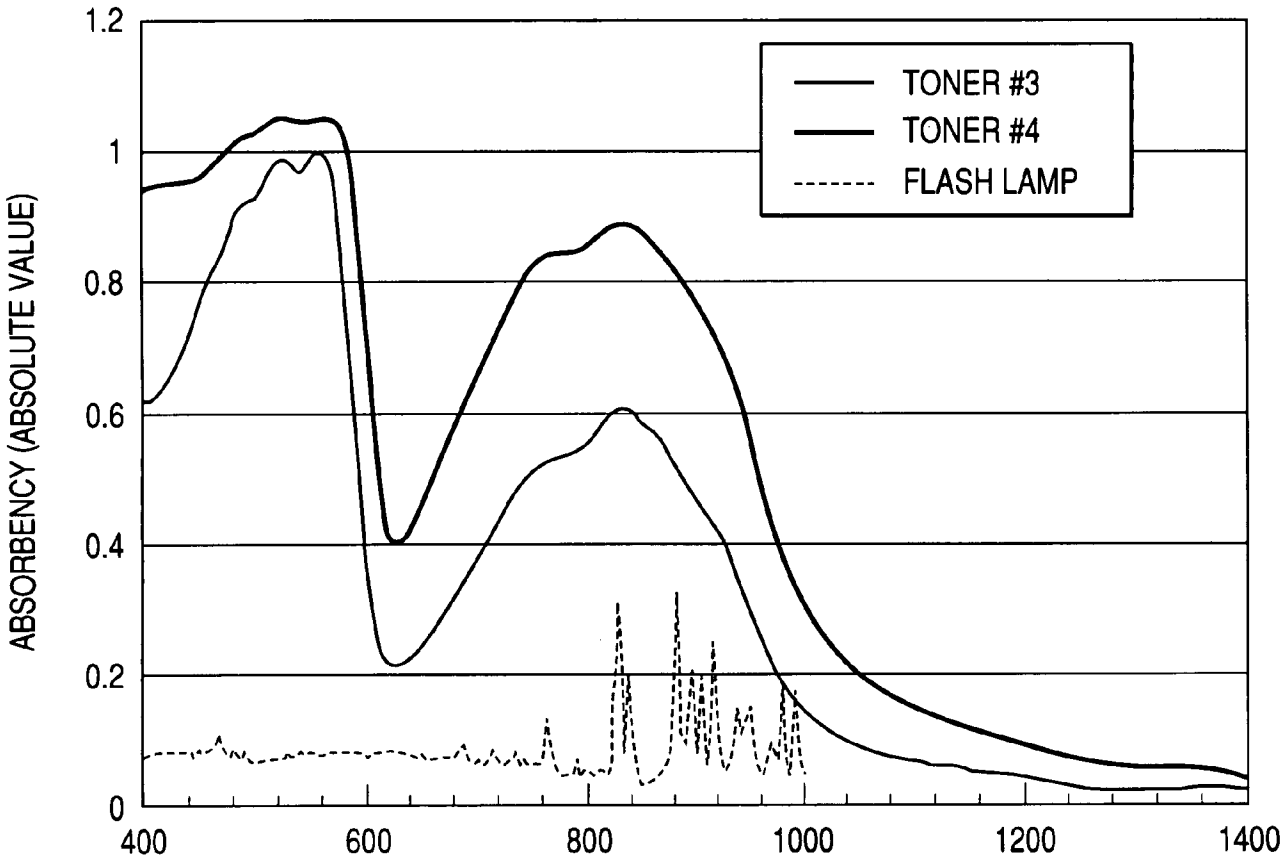
FIG. 16 is a graph showing the relation between absorption wavelength and amount of added infrared-absorbing agent.

FIG. 15 is a graph showing the relation between the kind of the infrared-absorbing agent and the absorption wavelength of light. FIG. 16 is a graph showing the relation between the amount of the added infrared-absorbing agent and the absorption wavelength of light. Here is described the relation between the kind/amount of the infrared-absorbing agent added to color toner and the wavelength (nm) of light absorbed to the color toner in order to improve absorbency (i.e., absorptivity) for the infrared region of light emitted from the flash lamp.

The graph of FIG. 15 shows change in wavelength of light absorbed to color toner in the case where one selected from different kinds of infrared-absorbing agents (toner #1 and toner #2) is added to the color toner. It is obvious from the graph of FIG. 15 that the quality of an image in the case of toner #2 (represented by the thick solid line) is good because absorbency is reduced in the visible region but an absorption wavelength peak is in the center of the infrared region. On the contrary, in the case of toner #1 (represented by the thin solid line), color toner becomes turbid because absorbency is high in the visible region. Therefore, when color toner containing such an infrared-absorbing agent is used as color toner for forming a color image, the amount of the added infrared-absorbing agent is controlled to make the range of color reproduction as wide as possible.

The graph of FIG. 16 shows change in wavelength of light absorbed to color toner in the case where the amount of the infrared-absorbing agent added to the same type of color toner is changed. More specifically, in the case of toner #3, 0.25% of the infrared-absorbing agent is added to color toner. In the case of toner #4, 1.05% of the infrared-absorbing agent is added to the same type of color toner. In the graph of FIG. 16, toner #3 and toner #4 are compared with each other on the basis of absorbency in the infrared region. In the case of toner #4 (represented by the thick solid line), light absorption efficiency is good and fixing characteristic is good because absorbency takes a high value in the infrared region in which the wavelength of light emitted from the flash light is 800 nm or higher. On the contrary, in the case of toner #3 (represented by the thin solid line), fixing characteristic is poor because absorbency is low in the infrared region.

According to the embodiment of the invention, an image forming apparatus forms an image on a printing medium. A plurality of color types of toner are disposed on a transport path of the printing medium in accordance with the image data to be printed on the printing medium. Toner images corresponding to the color types of toner are transferred color-by-color onto the printing medium. Light emitted from a flash lamp melts and fixes the toner images. The image forming apparatus is set so that the toner images corresponding to the color types of toner are color-by-color fixed in ascending order of toner's absorptivity of the light emitted from the flash lamp.

The order of the color types of toner used when the toner images are fixed may be determined as follows. Toner of at least one color of yellow, red and blue having low absorptivity of the light emitted from the flash lamp in the infrared light region is selected as a first toner. Black toner having good absorptivity of the light emitted from the flash lamp in the entire region is selected as a second toner.

An infrared absorbing agent for absorbing energy of light in the infrared region may be added to the toner of the at least one color of yellow, red and blue.

Yellow toner, red toner, blue toner and black toner may be used when the toner images are fixed. The toner images corresponding to the yellow toner, the red toner, the blue toner and the black toner may be color-by-color fixed in order of the yellow toner, the red toner, the blue toner and the black toner selected in ascending order of toner's absorptivity of the light emitted from the flash lamp.

According to the embodiment of the invention, an image forming apparatus forms an image on a printing medium. A plurality of color types of toner are disposed on a transport path of the printing medium in accordance with the image data to be printed on the printing medium. Toner images corresponding to the color types of toner are transferred color-by-color onto the printing medium. Light emitted from a flash lamp melts and fixes the toner images. The image forming apparatus is set so that the toner images corresponding to the color types of toner are color-by-color fixed in descending order of toner's reflectivity of the light emitted from the flash lamp.

The order of the color types of toner used when the toner images are fixed may be determined as follows. Toner of at least one color of yellow, red and blue having high reflectivity of the light emitted from the flash lamp in the infrared light region is selected as a first toner. Black toner having low reflectivity of the light emitted from the flash lamp in the entire region is selected as a second toner.

Yellow toner, red toner, blue toner and black toner may be used when the toner images are fixed. The toner images corresponding to the yellow toner, the red toner, the blue toner and the black toner are color-by-color fixed in order of the yellow toner, the red toner, the blue toner and the black toner selected in descending order of toner's reflectivity of the light emitted from the flash lamp.

According to the embodiment of the invention, an image forming method includes developing an electrostatic latent image formed on a photoconductor drum in accordance with image data to be printed on a printing medium; color-by-color transferring toner images, which is formed on the photoconductor drum in accordance with the electrostatic latent image, onto the printing medium in accordance with a plurality of color types of toner disposed along a transport path of the printing medium; and melting and fixing the toner images by light emitted from a flash lamp to form the image on the printing medium. The toner images corresponding to the color types of toner are color-by-color fixed in ascending order of toner's absorptivity of the light emitted from the flash lamp.

According to the embodiment of the invention, an image forming method includes developing an electrostatic latent image formed on a photoconductor drum in accordance with image data to be printed on a printing medium; color-by-color transferring toner images, which is formed on the photoconductor drum in accordance with the electrostatic latent image, onto the printing medium in accordance with a plurality of color types of toner disposed along a transport path of the printing medium; and melting and fixing the toner images by light emitted from a flash lamp to form the image on the printing medium. The toner images corresponding to the color types of toner are color-by-color fixed in descending order of toner's reflectivity of the light emitted from the flash lamp.

As described above, in the image forming apparatus and the image forming method according to the embodiment of the invention, in case of color-by-color fixing toner images of a plurality of color types of toner on a printing medium sequentially, the order of fixing is decided so that the toner images corresponding to the color types of toner are color-by-color fixed in ascending order of toner's absorptivity of light emitted from the flash lamp (or in descending order of toner's reflectivity of the light).

Consequently, in accordance with the embodiment of the invention, because the order of fixing of the toner images on the printing medium is decided in advance, the number of repetitions for fixing toner having low absorptivity of the light emitted from the flash lamp can be increased. Accordingly, toner having low absorptivity can sufficiently absorb the energy of the light emitted from the flash lamp, so that lowering of fixing characteristic can be prevented from being caused by poor fixing of toner.

Furthermore, in accordance with the embodiment of the invention, because the toner images are color-by-color fixed in ascending order of toner's absorptivity of the light emitted from the flash lamp, heat generated in the toner image portion on the printing medium is reduced. Accordingly, partial shrinkage of the printing medium or shrinkage of molten toner can be suppressed, so that voids or transfer failure can be prevented from being caused by undulations or wrinkles of the printing medium.

What is claimed is:

1. An image forming apparatus for forming an image on a printing medium, comprising:

a plurality of printing units disposed in tandem on a transport path of the printing medium respectively for generating images of color toners in accordance with image data to be printed on the printing medium and for transferring the images of the color toners color-by-color onto the printing medium; and flash lamps for emitting light to melt and fix the toner images, wherein:

the printing units are disposed so that the toner images corresponding to the color types of toner are color-by-color fixed in ascending order of toner's absorptivity of the light emitted from the flash lamp.

2. The image forming apparatus according to claim 1, wherein the order of the printing units is determined so that:

the printing unit having the color toner of yellow, red or blue is selected as a first printing unit; and the printing unit having black toner is selected as the last printing unit.

3. The image forming apparatus according to claim 2, wherein an infrared absorbing agent for absorbing energy of light in the infrared region is added to the toner of the at least one color of yellow, red and blue.

4. An image forming apparatus for forming an image on a printing medium, comprising:

a plurality of printing units disposed in tandem on a transport path of the printing medium respectively for generating images of color toners in accordance with image data to be printed on the printing medium and for transferring the images of the color toners color-by-color onto the printing medium; and flash lamps for emitting light to melt and fix the toner images, wherein:

the printing units are disposed so that the toner images corresponding to the color toners are color-by-color fixed in descending order of toner's reflectivity of the light emitted from the flash lamps.

5. An image forming method comprising:

developing an electrostatic latent image formed on a photoconductor drum in accordance with image data to be printed on a printing medium;

color-by-color transferring toner images, which is formed on the photoconductor drum in accordance with the electrostatic latent image, onto the printing medium in accordance with a plurality of color types of toner disposed along a transport path of the printing medium; and melting and fixing the toner images by light emitted from a flash lamp to form the image on the printing medium, wherein:

the toner images corresponding to the color types of toner are color-by-color fixed in ascending order of toner's absorptivity of the light emitted from the flash lamp.

6. An image forming apparatus for forming an image on a printing medium by means of a plurality of color types of toner, comprising:

a plurality of image forming units, wherein:

each of image forming units includes:

a photoconductor drum on which an electrostatic image is formed;

a developing unit for supplying one of the color types of toner to the photoconductor drum to form a toner image;

a transferring unit for transferring the toner image onto a printing medium; and a fixing unit including a flash lamp for emitting light to melt and fix the toner image; and the image forming units are arranged so that the color types of toner of the image forming units are arranged in ascending order of toner's absorptivity of the light emitted from the flash lamp.

7. The image forming apparatus according to claim 6, further comprising:

a transport guide for guiding the printing medium, disposed between the image forming units.

8. The image forming apparatus according to claim 6, wherein:

the color types of toner includes black toner and at least one color toner other than the black toner; and drive voltage of the flash lamp for the at least one color toner is higher than that of the flash lamp for the black toner.

9. The image forming apparatus according to claim 6, wherein:

the color types of toner includes yellow toner, magenta toner, cyan toner, and black toner; and the image forming units for the yellow toner, the magenta toner, and the cyan toner are disposed at a previous stage of the image forming unit for the black toner.

10. The image forming apparatus according to claim 6, wherein fixing rate of each color type of toner is not smaller than 90%.

11. The image forming apparatus according to claim 6, wherein:

the color types of toner includes black toner and at least one of yellow toner, red toner, and blue toner;

the toner other than the black toner is fixed prior to fixing of the black toner.

12. The image forming apparatus according to claim 11, wherein an infrared absorbing agent for absorbing energy of light in the infrared region is added to the toner other than the black toner.

* * * * *